US009214726B2

(12) United States Patent
Aydin et al.

(10) Patent No.: US 9,214,726 B2
(45) Date of Patent: Dec. 15, 2015

(54) HIGH FREQUENCY PHASE SHIFTER ARRAY TESTING

(71) Applicant: International Business Machines Corporation, Armonk, NY (US)

(72) Inventors: Adem G. Aydin, South Burlington, VT (US); Hanyi Ding, Colchester, VT (US)

(73) Assignee: International Business Machines Corporation, Armonk, NY (US)

( * ) Notice: Subject to any disclaimer, the term of this patent is extended or adjusted under 35 U.S.C. 154(b) by 427 days.

(21) Appl. No.: 13/746,029

(22) Filed: Jan. 21, 2013

(65) Prior Publication Data

US 2014/0203967 A1 Jul. 24, 2014

(51) Int. Cl.
*H01Q 3/26* (2006.01)

(52) U.S. Cl.
CPC . *H01Q 3/267* (2013.01); *H01Q 3/26* (2013.01)

(58) Field of Classification Search
CPC ..... H01Q 3/26; H01Q 3/2605; H01Q 3/36
USPC ..... 342/368, 372, 380, 383; 343/703, 778
See application file for complete search history.

(56) References Cited

U.S. PATENT DOCUMENTS

| | | | |
|---|---|---|---|
| 3,378,846 | A | 4/1968 | Lowenschuss |
| 5,081,460 | A | 1/1992 | Liu |
| 5,294,934 | A | 3/1994 | Matsumoto |
| 6,630,900 | B2 | 10/2003 | Stierlin et al. |
| 6,636,173 | B2 | 10/2003 | Graham |
| 6,940,453 | B2 | 9/2005 | Kim |
| 7,009,560 | B1 | 3/2006 | Lam et al. |
| 7,372,398 | B2 | 5/2008 | Chandler |
| 7,714,775 | B2 | 5/2010 | Navarro et al. |
| 7,920,089 | B2 | 4/2011 | Walker |
| 7,994,980 | B2 | 8/2011 | Son et al. |
| 2006/0044185 | A1 | 3/2006 | Jin et al. |
| 2010/0164782 | A1 | 7/2010 | Saha et al. |
| 2011/0063169 | A1 | 3/2011 | Chen et al. |

*Primary Examiner* — Dao Phan

(74) *Attorney, Agent, or Firm* — Steven J Meyers; Hoffman Warnick LLC

(57) ABSTRACT

Aspects of the invention provide for an architecture and method for testing high frequency phase shifter arrays. In one embodiment, an architecture for testing a phase shifter array, includes: a plurality of power dividers, each power divider configured to receive an output from a phase shifter within the phase shifter array and split the output into a first signal and a second signal; a plurality of power clippers, each power clipper configured to receive the second signal and modify the second signal by limiting an amplitude of the second signal; a first power combiner configured to receive the first signal from each of the plurality of power dividers to generate a first output; and a second power combiner configured to receive the modified second signal from each of the plurality of power clippers to generate a second output.

20 Claims, 3 Drawing Sheets

HIGH FREQUENCY PHASE SHIFTER ARRAY TESTING

BACKGROUND OF THE INVENTION

The subject matter disclosed herein relates generally to phase shifter arrays. More specifically, the disclosure provided herein relates to an architecture and method for testing high frequency phase shifter arrays.

In integrated circuit production tests, with higher carrier frequencies, significant benefits include data rates, security, and resolution. However, there may be substantial path loss at a given range and increased shadowing, which would make non-line-of-sight (NLOS) communications challenging. Steerable, high-gain antennas are an option to overcome these limitations, and phase shifter arrays are a way to implement them.

BRIEF DESCRIPTION OF THE INVENTION

Aspects of the invention provide for an architecture and method for testing high frequency phase shifter arrays. In one embodiment, an architecture for testing a phase shifter array is provided. The architecture includes: a plurality of power dividers, each power divider configured to receive an output from a phase shifter within the phase shifter array and split the output into a first signal and a second signal; a plurality of power clippers, each power clipper configured to receive the second signal and modify the second signal by limiting an amplitude of the second signal; a first power combiner configured to receive the first signal from each of the plurality of power dividers to generate a first output; and a second power combiner configured to receive the modified second signal from each of the plurality of power clippers to generate a second output.

A first aspect of the invention provides an architecture for testing a phase shifter array, comprising: a plurality of power dividers, each power divider configured to receive an output from a phase shifter within the phase shifter array and split the output into a first signal and a second signal; a plurality of power clippers, each power clipper configured to receive the second signal and modify the second signal by limiting an amplitude of the second signal; a first power combiner configured to receive the first signal from each of the plurality of power dividers to generate a first output; and a second power combiner configured to receive the modified second signal from each of the plurality of power clippers to generate a second output.

A second aspect of the invention provides a computer-implemented method of testing a phase shifter array, the method comprising: splitting each output of a plurality of phase shifters within the phase shifter array into a first signal and a second signal; modifying each second signal by limiting an amplitude of each second signal; combining each of the first signals into a first output; and combining each of the modified second signals into a second output.

A third aspect of the invention provides a computer program comprising program code embodied in at least one computer-readable storage medium, which when executed, enables a computer system to implement a method of testing a phase shifter array, the method comprising: splitting each output of a plurality of phase shifters within the phase shifter array into a first signal and a second signal; modifying each second signal by limiting an amplitude of each second signal; combining each of the first signals into a first output; and combining each of the modified second signals into a second output.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings of the invention are not to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As mentioned above, the subject matter disclosed herein relates generally to phase shifter arrays. More specifically, the disclosure provided herein relates to an architecture and method for testing high frequency phase shifter arrays.

In integrated circuit production tests, with higher carrier frequencies, significant benefits include data rates, security, and resolution. However, there may be substantial path loss at a given range and increased shadowing, which would make non-line-of-sight (NLOS) communications challenging. Steerable, high-gain antennas are an option to overcome these limitations, and phase shifter arrays are a way to implement them.

Figure 1:
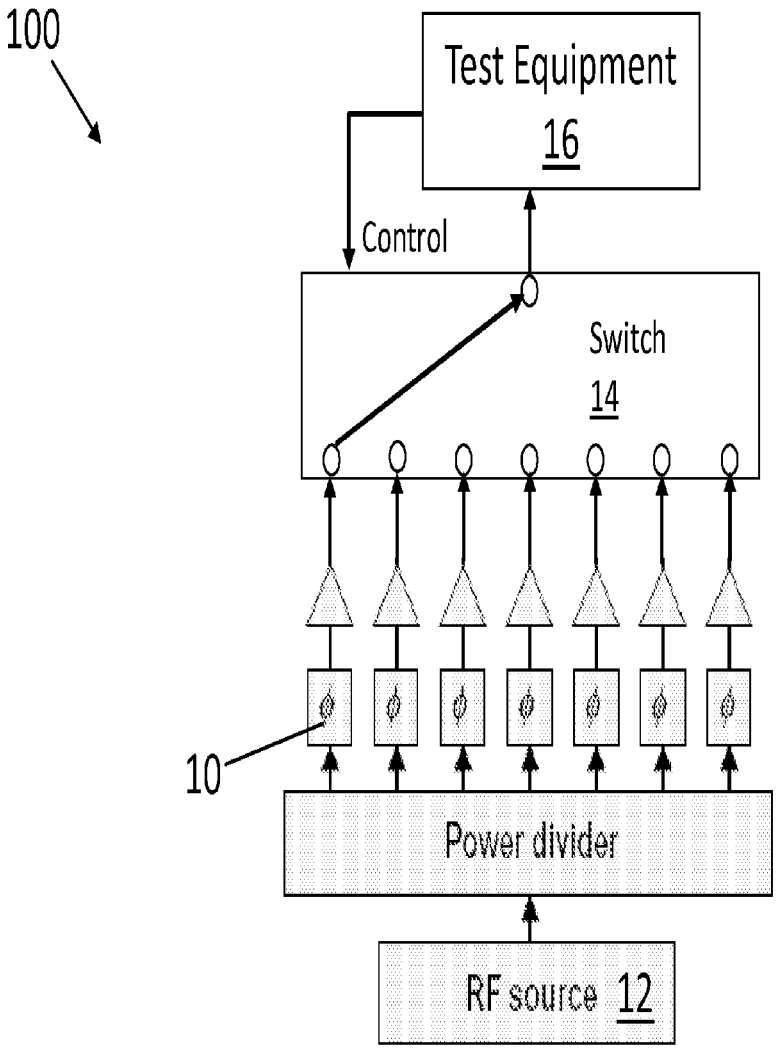
FIG. 1 Related Art
FIG. 1 shows a schematic diagram of a conventional testing architecture.

Unfortunately, testing structures at millimeter wave frequencies in production may be challenging. Turning now to FIG. 1, a schematic diagram of a conventional testing architecture 100 is shown. A radio frequency (RF) source 12 provides an input to a plurality of phase shifters 10 (in a phase shift array). One method of testing each phase shifter 10 is to connect each phase shifter 10 to the test equipment 16 and terminate the connection of the other phase shifters 10 to the test equipment 16 (i.e., manual connections). Another method of testing each phase shifter 10, as shown in FIG. 1, is to use a switch 14 to electronically switch the connection between the test equipment 16 and each phase shifter 10. However, the use of this switch 14 at millimeter wave frequencies can be expensive and bulky.

Aspects of the invention provide for an architecture and method for testing high frequency phase shifter arrays. In one embodiment, an architecture for testing a phase shifter array is provided. The architecture includes: a plurality of power dividers, each power divider configured to receive an output from a phase shifter within the phase shifter array and split the output into a first signal and a second signal; a plurality of power clippers, each power clipper configured to receive the second signal and modify the second signal by limiting an amplitude of the second signal; a first power combiner configured to receive the first signal from each of the plurality of power dividers to generate a first output; and a second power combiner configured to receive the modified second signal from each of the plurality of power clippers to generate a second output.

Figure 2:
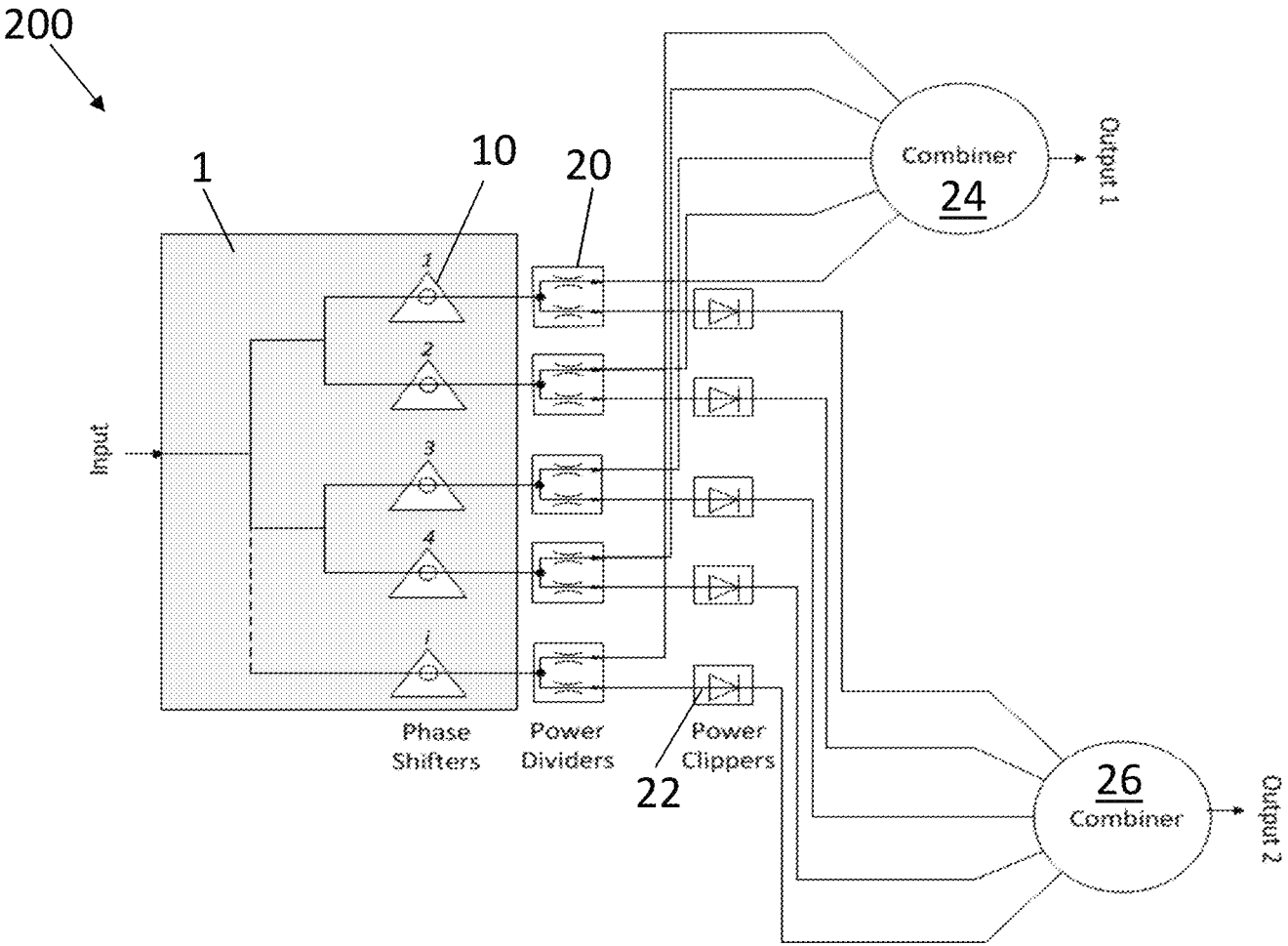
FIG. 2 shows a schematic diagram of a testing architecture for a phase shifter array according to embodiments of the invention.

Turning now to FIG. 2, a schematic diagram of an architecture 200 for testing a plurality of phase shifters 10 (or "a phase shifter array" 1) according to embodiments of the invention is shown. Input is from an RF source, such as RF source 12 in FIG. 1. The input signal is received by each of the plurality of phase shifters 10. A plurality of power dividers 20 is provided to receive the output of each of the phase shifters 10. Each of the power dividers 20 splits the output of each phase shifter 10 into a first signal and a second signal. Power dividers 20 split the output equally, such that the first signal is equal to the second signal. That is, the first signal includes the same phase and amplitude as the second signal. Each power divider 20 may include a power divider, as known in the art, such as, but not limited to, a Wilkinson power divider.

A plurality of power clippers 22 is provided to receive the second signal from the power dividers 20 in order to modify the second signal by limiting the amplitude of the second signal. Each power clipper 22 may include any circuitry that limits each of the second signals to the same amplitude level. For example, a power clipper 22 may include a pair of rectifying diodes that limit the peak voltage (i.e., amplitude).

Each of the first signals from the plurality of power dividers 20 is received by a first power combiner 24, and are combined by the first power combiner 24, which outputs a first output ("Output1"). This first output corresponds to the amplitude output. Each of the modified second signals (from the plurality of power clippers 22) is received by the second power combiner 26, and are combined by the second power combiner 26, which outputs a second output ("Output2"). This second output corresponds to the phase output. Each power combiner 24, 26 may include any multiport radial power combiner, as known in the art.

The first output ("Output1") and second output ("Output2"), which correspond to the amplitude and phase output of the phase shifters 10, can then be sent to any test equipment in order to be tested.

Figure 3:
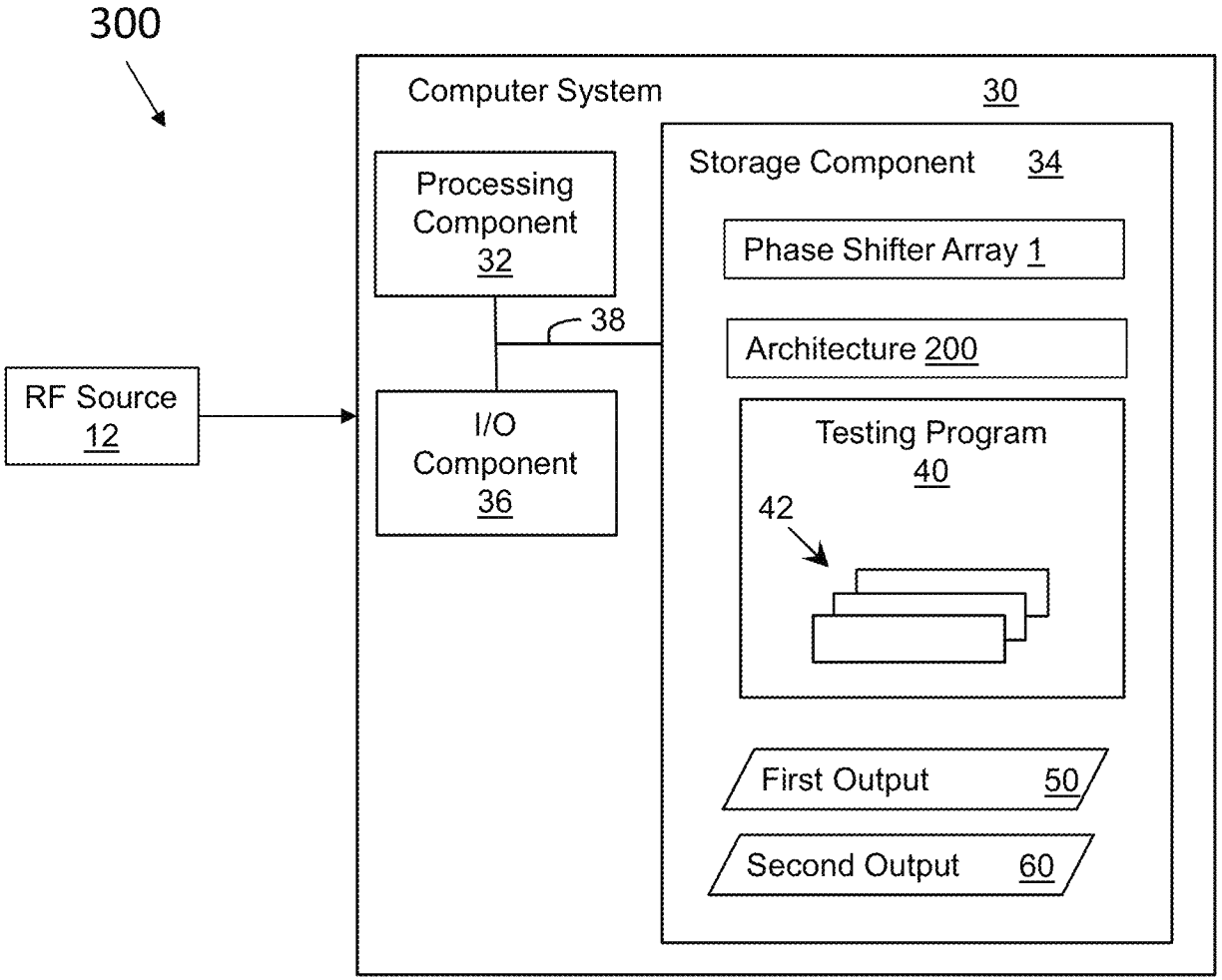
FIG. 3 shows an illustrative environment according to embodiments of the invention.

Turning now to FIG. 3, an illustrative environment 300 for testing a phase shifter array 1 according to embodiments of the invention is shown. To this extent, environment 300 includes a computer system 30 that can perform a process described herein in order to test a phase shifter array 1. In particular, computer system 30 is shown including a phase shifter array 1, architecture 200 (as shown in FIG. 2, including phase shifter array 1), and a testing program 40, which makes computer system 30 operable to evaluate and test the phase shifter array 1 (i.e., test the first output 50 and second output 60) by performing the process described below.

Computer system 30 is shown including a processing component 32 (e.g., one or more processors), a storage component 34 (e.g., a storage hierarchy), an input/output (I/O) component 36 (e.g., one or more I/O interfaces and/or devices), and a communications pathway 38. In general, processing component 32 executes program code, such as testing program 40, which is at least partially fixed in storage component 34. While executing program code, processing component 32 can process data, which can result in reading and/or writing transformed data from/to storage component 34 and/or I/O component 36 for further processing. Pathway 38 provides a communications link between each of the components in computer system 30. I/O component 36 can comprise one or more human I/O devices, which enable a user to interact with computer system 30 and/or one or more communications devices to enable a user to communicate with computer system 30 using any type of communications link. To this extent, testing program 40 can manage a set of interfaces (e.g., graphical user interface(s), application program interface, and/or the like) that enable human and/or system users to interact with testing program 40. Further, testing program 40 can manage (e.g., store, retrieve, create, manipulate, organize, present, etc.) the data, such as the first output 50 and/or the second output 60 in order to test the phase shifter array 1, using any solution.

In any event, computer system 30 can comprise one or more general purpose computing articles of manufacture (e.g., computing devices) capable of executing program code, such as testing program 40, installed thereon. As used herein, it is understood that "program code" means any collection of instructions, in any language, code or notation, that cause a computing device having an information processing capability to perform a particular action either directly or after any combination of the following: (a) conversion to another language, code or notation; (b) reproduction in a different material form; and/or (c) decompression. To this extent, testing program 40 can be embodied as any combination of system software and/or application software.

Further, testing program 40 can be implemented using a set of modules 42. In this case, a module 42 can enable computer system 30 to perform a set of tasks used by testing program 40, and can be separately developed and/or implemented apart from other portions of testing program 40. As used herein, the term "component" means any configuration of hardware, with or without software, which implements the functionality described in conjunction therewith using any solution, while the term "module" means program code that enables a computer system 30 to implement the actions described in conjunction therewith using any solution. When fixed in a storage component 34 of a computer system 30 that includes a processing component 32, a module is a substantial portion of a component that implements the actions. Regardless, it is understood that two or more components, modules, and/or systems may share some/all of their respective hardware and/or software. Further, it is understood that some of the functionality discussed herein may not be implemented or additional functionality may be included as part of computer system 30.

When computer system 30 comprises multiple computing devices, each computing device can have only a portion of testing program 40 fixed thereon (e.g., one or more modules 42). However, it is understood that computer system 30 and testing program 40 are only representative of various possible equivalent computer systems that may perform a process described herein. To this extent, in other embodiments, the functionality provided by computer system 30 and testing program 40 can be at least partially implemented by one or more computing devices that include any combination of general and/or specific purpose hardware with or without program code. In each embodiment, the hardware and program code, if included, can be created using standard engineering and programming techniques, respectively.

Regardless, when computer system 30 includes multiple computing devices, the computing devices can communicate over any type of communications link. Further, while performing a process described herein, computer system 30 can communicate with one or more other computer systems using any type of communications link. In either case, the communications link can comprise any combination of various types of optical fiber, wired, and/or wireless links; comprise any combination of one or more types of networks; and/or utilize any combination of various types of transmission techniques and protocols.

As discussed herein, testing program 40 enables computer system 30 to test phase shifter array 1 by using the first output 50 and second output 60 that are generated by architecture 200. To this extent, computer system 30 may perform the method according to aspects of the invention, as discussed herein.

Referring now to FIGS. 2-3, the method of testing (via testing program 40) phase shifter array 1 (including the plurality of phase shifters 10) will now be discussed. An input signal from RF source 12 into each phase shifter 10 may be represented as:

$$E_{in}e^{-j\phi in}.$$

wherein $E_{in}$ is the amplitude of the input signal and $\phi_{in}$ is the phase of the input signal. The output of each phase shifter 10 may be represented as:

$$E_n e^{j\phi n}$$

wherein $E_n$ is the amplitude of the input signal and $\phi_n$ is the phase of the input signal As mentioned above, the output of each of the phase shifters 10 within the phase shifter array 1 are split (via power dividers 20) into a first signal and a second signal. The second signal is modified (via power clippers 22) by limiting the amplitude of each of the second signals. Each of the first signals are combined (via first power combiner 24) into a first output 50 and each of the modified second signals are combined (via second power combiner 26) into a second output 60. First output 50 corresponds to an amplitude output, while second output 60 corresponds to a phase output.

The second output 60 of the second power combiner 26 is measured and compared against an expected second output. The equation for the second output is represented as:

$$E_{out,2}e^{-j\phi_{out,2}}=E(e^{-j\phi 1}+e^{-j\phi 2}+\ldots+e^{-j\phi n}).$$

Comparing the measured value of the second output 60 against this expected value will reveal if the phases are equal (i.e., if $\phi=\phi_1=\phi_2=\ldots=\phi_n$). If not, then the test fails. However, if the phases are equal, then the first output 50 of the first power combiner 24 is measured and compared against an expected first output. The equation for the first output is represented as:

$$E_{out,1}e^{-j\phi_{out,1}}=e^{j\phi}(E_1+E_2+\ldots+E_n).$$

Comparing the measured value of the first output 50 against this expected value will reveal if the amplitudes are equal (i.e., if $E=E_1=E_2=\ldots=E_n$). If not, then the test fails. This test would confirm if the phase shifters 10 operate properly.

The test may further continue to determine if an output of a phase shifter 10 is accurate if the phase shifter 10 is shifted by a phase. For example, if the first phase shifter 10 is shifted by $\Delta\phi$, the first output 50 is represented as:

$$(E_{out}e^{j\phi_{out}})'=(E_1+E_1)e^{j(\phi 1\Delta\phi)}+E_2e^{j\phi 2}+\ldots+E_ne^{j\phi n}$$

Therefore, the amplitude can be written as:

$$|E_1e^{\phi 1}(e^{j\Delta\phi 1}-1)|=\sqrt{(E_1+\Delta E_1)^2+(E_1)^2-2(E_1+\Delta E_1)E_1\cos\Delta\phi_1},$$

while the phase can be written as:

$$\phi=\phi_1+\tan^{-1}\left(\frac{(E_1+\Delta E_1)\sin\Delta\phi_1}{((E_1+\Delta E_1)\cos\Delta\phi_1-E_1)}\right).$$

The amplitude and phase is compared to determine if it is the correct phase shift and same amplitude. If so, then the phase shifter 10 is accurate.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An architecture for testing a phase shifter array, comprising:

a plurality of power dividers, each power divider configured to receive an output from a phase shifter within the phase shifter array and split the output into a first signal and a second signal;

a plurality of power clippers, each power clipper configured to receive the second signal and modify the second signal by limiting an amplitude of the second signal;

a first power combiner configured to receive the first signal from each of the plurality of power dividers to generate a first output; and a second power combiner configured to receive the modified second signal from each of the plurality of power clippers to generate a second output.

2. The architecture of claim 1, further comprising a phase shifter array including a plurality of phase shifters.

3. The architecture of claim 2, wherein the plurality of phase shifters simultaneously receive an input from a radio frequency (RF) source.

4. The architecture of claim 1, wherein the plurality of power dividers equally splits the output of each phase shifter, such that the first signal is equal to the second signal.

5. The architecture of claim 1, wherein the first output corresponds to an amplitude output.

6. The architecture of claim 1, wherein the second output corresponds to a phase output.

7. A computer-implemented method of testing a phase shifter array, the method comprising:

splitting each output of a plurality of phase shifters within the phase shifter array into a first signal and a second signal;

modifying each second signal by limiting an amplitude of each second signal;

combining each of the first signals into a first output; and combining each of the modified second signals into a second output.

8. The computer-implemented method of claim 7, wherein the first output corresponds to an amplitude output.

9. The computer-implemented method of claim 7, wherein the second output corresponds to a phase output.

10. The computer-implemented method of claim 7, further comprising:

measuring the second output; and comparing the measured second output to an expected second output to determine if each output of the plurality of phase shifters includes a same phase.

11. The computer-implemented method of claim 10, further comprising:

measuring the first output; and comparing the measured first output to an expected first output to determine if each output of the plurality of phase shifters includes a same amplitude.

12. The computer-implemented method of claim 11, further comprising:

shifting a phase shifter within the plurality of phase shifters by a phase.

13. The computer-implemented method of claim 12, further comprising:

measuring the modified first output; and comparing the modified first output to the first output to determine if the shifted phase shifter provided a correct phase shift.

14. A computer program comprising program code embodied in at least one non-transitory computer-readable medium, which when executed, enables a computer system to implement a method of testing a phase shifter array, the method comprising:

splitting each output of a plurality of phase shifters within the phase shifter array into a first signal and a second signal;

modifying each second signal by limiting an amplitude of each second signal;

combining each of the first signals into a first output; and combining each of the modified second signals into a second output.

15. The computer program of claim 14, wherein the first output corresponds to an amplitude output.

16. The computer program of claim 14, wherein the second output corresponds to a phase output.

17. The computer program of claim 14, further comprising:

measuring the second output; and comparing the measured second output to an expected second output to determine if each output of the plurality of phase shifters includes a same phase.

18. The computer program of claim 17, further comprising:

measuring the first output; and comparing the measured first output to an expected first output to determine if each output of the plurality of phase shifters includes a same amplitude.

19. The computer program of claim 18, further comprising:

shifting a phase shifter within the plurality of phase shifters by a phase.

20. The computer program of claim 19, further comprising:

measuring the modified first output; and comparing the modified first output to the first output to determine if the shifted phase shifter provided a correct phase shift.

* * * * *